US011691430B2

(12) United States Patent
Ninagawa

(10) Patent No.: US 11,691,430 B2
(45) Date of Patent: Jul. 4, 2023

(54) PRESSURE CONTROL UNIT AND METHOD OF DRYING THE SAME

(71) Applicant: CANON KABUSHIKI KAISHA, Tokyo (JP)

(72) Inventor: Takeshi Ninagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/685,187

(22) Filed: Mar. 2, 2022

(65) Prior Publication Data

US 2022/0305802 A1 Sep. 29, 2022

(30) Foreign Application Priority Data

Mar. 29, 2021 (JP) ..... 2021-056091
Dec. 2, 2021 (JP) ..... 2021-196006

(51) Int. Cl.
*B41J 2/175* (2006.01)

(52) U.S. Cl.
CPC ..... *B41J 2/17596* (2013.01)

(58) Field of Classification Search
CPC ..... B41J 2/17523; B41J 2/17513; B41J 2002/17516; B41J 2/17556; B41J 2/17596; B41J 2/1721
See application file for complete search history.

(56) References Cited

U.S. PATENT DOCUMENTS

| | | | | |
|---|---|---|---|---|
| 7,862,138 | B2 | 1/2011 | Haines et al. | 347/17 |
| 9,914,308 | B2 * | 3/2018 | Yamada | B41J 2/17563 |
| 11,520,359 | B2 * | 12/2022 | Yoshii | B41J 2/17556 |
| 2004/0257413 | A1 * | 12/2004 | Anderson, Jr. | B41J 2/17556 347/86 |

* cited by examiner

*Primary Examiner* — An H Do
(74) *Attorney, Agent, or Firm* — Venable LLP

(57) ABSTRACT

To reduce the amount of a liquid that remains in a boundary portion between a pressure receiving plate and a flexible member. Provides is a pressure control unit including a pressure chamber configured, at least a part of a wall forming the pressure chamber being formed of a flexible member; a flow inlet; a flow outlet; a pressure receiving plate, which is provided on an inner surface of the flexible member, and is to be displaced toward an inner side and an outer side of the pressure chamber; a valve member configured to open and close the flow inlet in accordance with the displacement of the pressure receiving plate; and an internal flow passage, which extends in a boundary portion between the pressure receiving plate and the flexible member along the inner surface of the flexible member, and is opened on a side surface of the pressure receiving plate.

17 Claims, 8 Drawing Sheets

PRESSURE CONTROL UNIT AND METHOD OF DRYING THE SAME

BACKGROUND OF THE INVENTION

Field of the Invention

The present invention relates to a pressure control unit of a liquid ejection head that ejects a liquid such as an ink.

Description of the Related Art

A liquid ejection head includes a pressure control unit for adjusting the pressure in an ejection orifice and in a flow passage that communicates to the ejection orifice. The pressure control unit includes a pressure chamber having a flow inlet and a flow outlet, and a part of a side wall of the pressure chamber is formed of a flexible member. A pressure receiving plate is provided on an inner surface of the flexible member, and the flow inlet is opened and closed in accordance with the displacement of the pressure receiving plate. In U.S. Pat. No. 7,862,138, there is described a pressure control unit having a structure similar to that of the above-mentioned pressure chamber.

In general, in a manufacturing process of the liquid ejection head, inspection such as an ejection operation of the liquid ejection head is performed. When the inspection is finished, the inside of the liquid ejection head as well as the pressure control unit are cleaned with a cleaning liquid. After the cleaning, the inside of the liquid ejection head is dried, and the liquid ejection head is packaged.

However, in the above-mentioned pressure control unit, the cleaning liquid may enter a gap between the pressure receiving plate and the flexible member, and the cleaning liquid that has entered the gap may remain even after the drying. When the amount of the remaining cleaning liquid is small, a problem is less liable to occur. However, when the liquid ejection head is packaged under a state in which a large amount of the liquid remains, the humidity in the package may be increased to corrode a substrate.

An object of the present invention is to reduce the amount of a liquid that remains in a boundary portion between the pressure receiving plate and the flexible member.

SUMMARY OF THE INVENTION

In order to achieve the above-mentioned object, according to the present invention, there is provided a pressure control unit comprising: a pressure chamber configured to accommodate a liquid, at least a part of a wall forming the pressure chamber being formed of a flexible member; a flow inlet configured to cause the liquid to flow into the pressure chamber; a flow outlet configured to cause the liquid to flow out from the pressure chamber; a pressure receiving plate, which is provided on an inner surface of the flexible member, and is to be displaced toward an inner side and an outer side of the pressure chamber; a valve member configured to open and close the flow inlet in accordance with the displacement of the pressure receiving plate; and an internal flow passage, which extends in a boundary portion between the pressure receiving plate and the flexible member along the inner surface of the flexible member, and is opened on a side surface of the pressure receiving plate.

Further features of the present invention will become apparent from the following description of exemplary embodiments with reference to the attached drawings.

DESCRIPTION OF THE EMBODIMENTS

Figure 1:
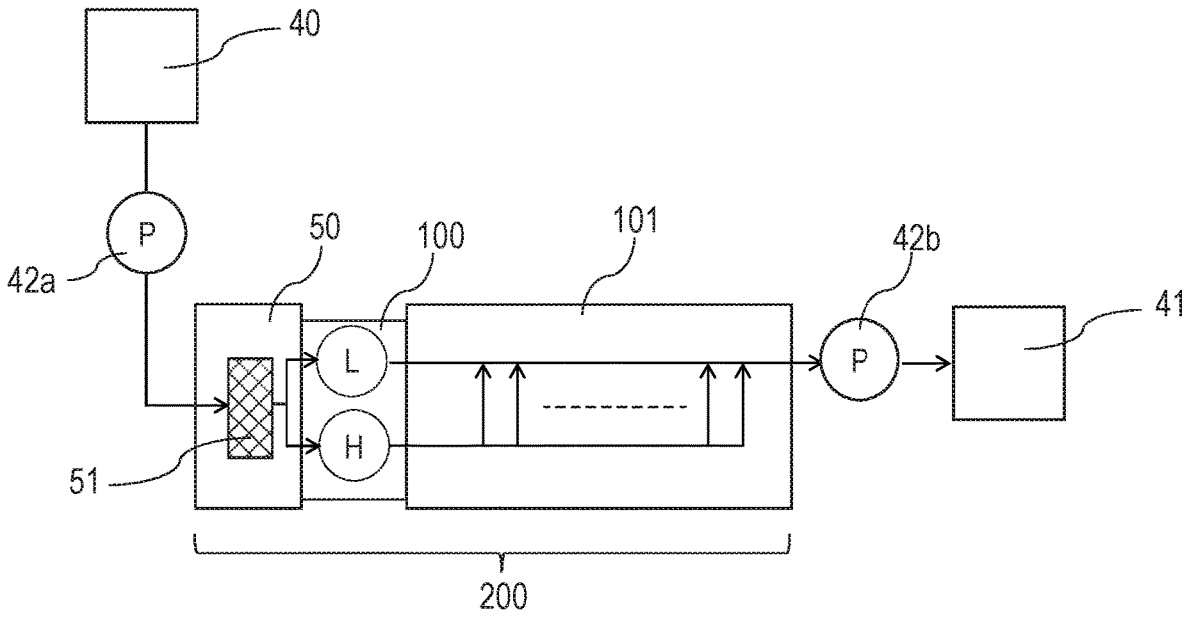
FIG. 1 is a schematic view for illustrating an example of a liquid supply system.

Now, referring to the drawings, embodiments of the present invention are described in detail. Note that, components described in the embodiment are merely exemplary, and are not intended to limit the scope of the present invention to the exemplary embodiments.

First, a liquid supply system that supplies a liquid to a liquid ejection head to which a pressure control unit of the present invention is applicable is described.

In FIG. 1, an example of the liquid supply system is illustrated. The liquid supply system includes a liquid storage tank 40, a waste liquid tank 41, pumps 42*a* and 42*b*, and a liquid ejection head 200. The liquid storage tank 40 and the liquid ejection head 200 are connected to each other through intermediation of the pump 42*a*, and the waste liquid tank 41 and the liquid ejection head 200 are connected to each other through intermediation of the pump 42*b*. The liquid storage tank 40 can accommodate a liquid such as an ink and a cleaning liquid. When the pumps 42*a* and 42*b* are operated, the liquid is supplied from the liquid storage tank 40 to the liquid ejection head 200, and the liquid that has passed through the inside of the liquid ejection head 200 is collected in the waste liquid tank 41.

The liquid ejection head 200 includes a filter unit 50, a pressure control unit 100, and a liquid ejection unit 101. The filter unit 50 includes a filter 51 for preventing foreign matter from entering the inside of the head. The pressure control unit 100 controls the pressure in the liquid ejection head 200, and includes a flow passage (H) on a high pressure side and a flow passage (L) on a low pressure side. The negative pressure of the flow passage (H) on the high pressure side is larger than the negative pressure of the flow passage (L) on the low pressure side.

The liquid ejection unit 101 includes a recording element substrate (not shown) having an ejection orifice for ejecting a liquid. After passing through the filter 51, the liquid is supplied to the flow passage (H) on the high pressure side and the flow passage (L) on the low pressure side. The flow passage (H) on the high pressure side and the flow passage (L) on the low pressure side communicate to each other through a flow passage formed on the recording element substrate in the liquid ejection unit 101. When the pumps 42*a* and 42*b* are operated to supply the liquid, a differential pressure is generated in the liquid ejection head 200 by the pressure control unit 100, and the liquid flowing through the flow passage (H) on the high pressure side is joined with the liquid flowing through the flow passage (L) on the low pressure side through the flow passage formed on the recording element substrate. Thus, the entire liquid ejection head 200 is filled with the liquid.

Next, the configuration of the pressure control unit 100 is described in detail.

Figure 2:
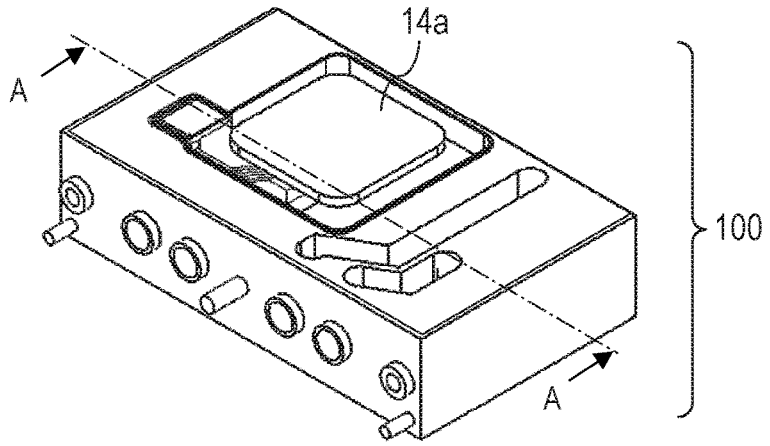
FIG. 2 is a perspective view for schematically illustrating the outer appearance of a pressure control unit.
Figure 3:
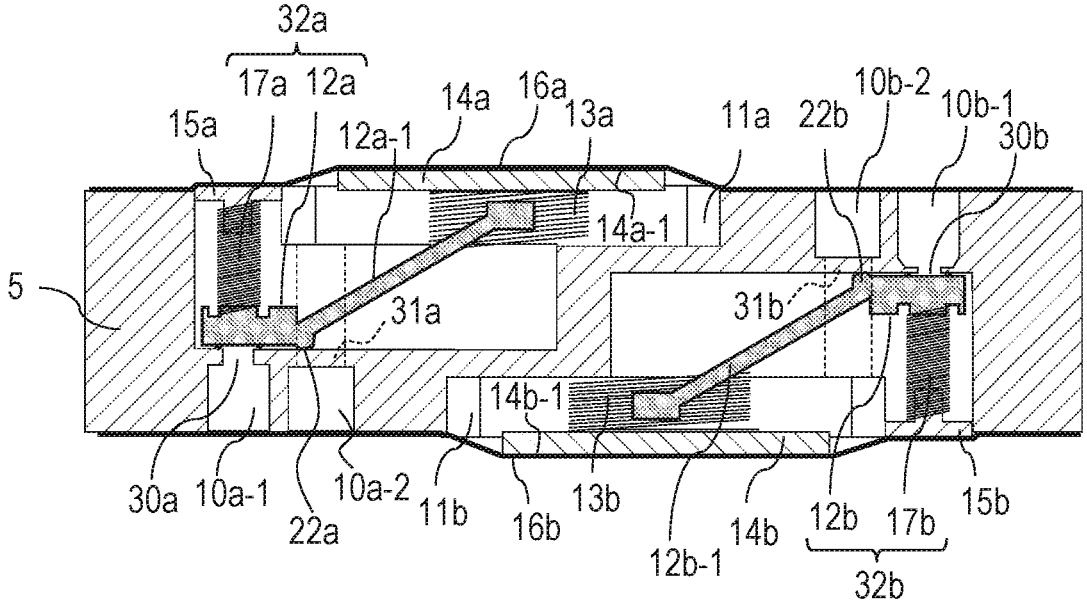
FIG. 3 is a sectional view of the pressure control unit taken along the line A-A of FIG. 2.

FIG. 2 is a perspective view for schematically illustrating the outer appearance of the pressure control unit 100. FIG. 3 is a sectional view for illustrating a cross-section of the pressure control unit 100 taken along the line A-A of FIG. 2. The pressure control unit 100 includes a case 5 having a pressure control structure on the high pressure side and a pressure control structure on the high pressure side in order to maintain the liquid supplied to the liquid ejection head 200 at negative pressure. The pressure control structure on the high pressure side and the pressure control structure on the low pressure side are basically the same structure. Accordingly, here, the configuration of the pressure control structure on the low pressure side is described in detail, and the description of the configuration of the pressure control structure on the high pressure side is omitted.

As illustrated in FIG. 3, the case 5 includes a pressure chamber 11*a* on the low pressure side. The pressure chamber 11*a* has a flow inlet 30*a* and a flow outlet 31*a*, and can accommodate a liquid. The liquid can be supplied into the pressure chamber 11*a* from the flow inlet 30*a*, and the liquid in the pressure chamber 11*a* can be discharged from the flow outlet 31*a*. At least a part of a wall forming the pressure chamber 11*a* is formed of a flexible member 16*a*. The flexible member 16*a* is, for example, a film having flexibility. The flexible member 16*a* can be deformed toward an inner side and an outer side of the pressure chamber 11*a*.

A pressure receiving plate 14*a* is provided on an inner surface of the flexible member 16*a*. The pressure receiving plate 14*a* has an abutment surface 14*a*-1 that is brought into abutment against the inner surface of the flexible member 16*a*, and a part of the abutment surface 14*a*-1 is fixed to the inner surface of the flexible member 16*a*. A negative pressure spring 13*a* is mounted on the pressure receiving plate 14*a*. The urging force of the negative pressure spring 13*a* causes the flexible member 16*a* to be deformed toward the outer side of the pressure chamber 11*a*. When the pressure chamber 11*a* is depressurized through suction from the flow outlet 31*a*, the flexible member 16*a* is deformed toward the inner side of the pressure chamber 11*a*. Along with the deformation of the flexible member 16*a*, the pressure receiving plate 14*a* is displaced to the inner side and the outer side of the pressure chamber 11*a*.

The pressure chamber 11*a* is provided with a valve member 32*a* that opens and closes the flow inlet 30*a* in accordance with the displacement of the pressure receiving plate 14*a*. The valve member 32*a* includes a valve body 12*a* that closes the flow inlet 30*a* and a valve spring 17*a* that urges the valve body 12*a* toward the flow inlet 30*a*. A cap 15*a* is provided at one end portion of the valve spring 17*a*. The cap 15*a* is brought into contact with a position opposed to the flow inlet 30*a* of the inner wall of the pressure chamber 11*a*. The valve body 12*a* is made of an elastic body such as rubber. The valve body 12*a* includes a shaft portion 22*a* and an arm 12*a*-1 extending from the vicinity of the shaft portion 22*a* toward the pressure receiving plate 14*a*. Under a state in which the valve body 12*a* closes the flow inlet 30*a*, the shaft portion 22*a* is brought into abutment against an edge of the flow inlet 30*a*. When the pressure receiving plate 14*a* is displaced toward the inner side of the pressure chamber 11*a*, the arm 12*a*-1 is brought into contact with the pressure receiving plate 14*a*.

The flow inlet 30*a* communicates to a liquid flow chamber 10*a*-1. The liquid flow chamber 10*a*-1 communicates to the filter unit 50 illustrated in FIG. 1. The flow outlet 31*a* communicates to a liquid flow chamber 10*a*-2. The liquid flow chamber 10*a*-2 communicates to the liquid ejection unit 101 illustrated in FIG. 1.

In the case 5, a pressure control structure similar to that on the low pressure side is formed also on the high pressure side. The reference symbol of each element on the high pressure side is given "b" instead of "a". The high pressure side (reference numeral "b") and the low pressure side (reference numeral "a") are the same as each other in the structure of the pressure control structure, and although the explanation of the structure is omitted, the structure of the high pressure side pressure control structure is understood by changing the reference numeral "a" of each element on the low pressure side to "b". The urging force of the negative pressure spring 13*a* on the low pressure side is larger than the urging force of the negative pressure spring 13*b* on the high pressure side.

Figure 4:
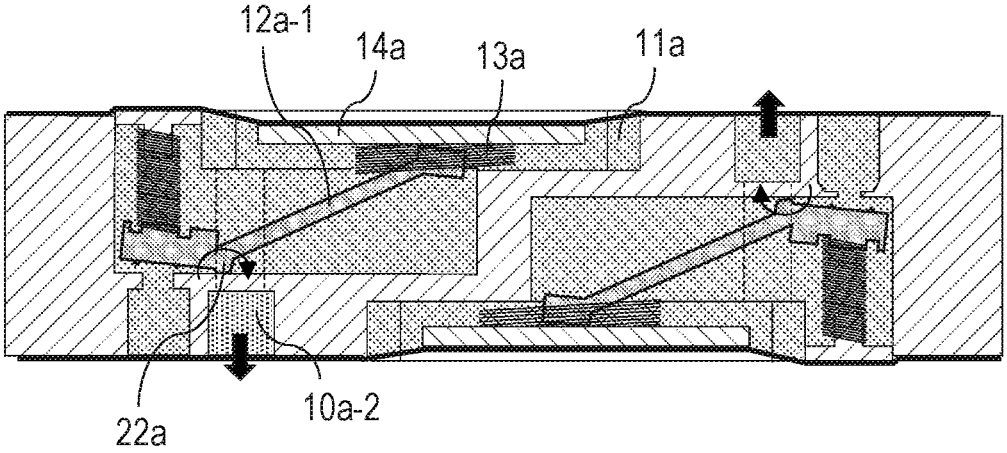
FIG. 4 is a schematic view for illustrating a state in which the pressure control unit is filled with a liquid.

FIG. 4 is a schematic view for illustrating a state in which the pressure control unit 100 is filled with the liquid. In FIG. 4, a cross-section of the pressure control unit 100 taken along the line A-A of FIG. 2 is illustrated. Here, the state in which the pressure chamber 11*a* on the low pressure side and the liquid flow chamber 10*a*-1 communicate to each other through supply of the liquid is described.

The liquid is filled into the pressure chamber 11*a* by depressurizing the inside of the pressure chamber 11*a* through suction from a downstream side of the pressure control unit 100 with the pump 42*b*. Specifically, when the inside of the pressure chamber 11*a* is depressurized, the flexible member 16*a* is deformed toward the inner side, and the pressure receiving plate 14*a* is displaced. Along with the displacement of the pressure receiving plate 14*a*, the negative pressure spring 13*a* contracts, and the pressure receiving plate 14*a* is brought into abutment against the arm 12*a*-1. When the pressure receiving plate 14*a* pushes down the arm 12*a*-1, the valve spring 17*a* contracts, and the valve body 12*a* rotates about the shaft portion 22*a*. When the valve body 12*a* rotates, the flow inlet 30*a* is opened, and the pressure chamber 11*a* communicates to the liquid flow chamber 10*a* to cause the liquid to be filled into the pressure chamber 11*a*. When the flow inlet 30*a* is opened, a negative pressure is generated by the negative pressure spring 13*a*, and the pressure of the liquid ejection head 200 is adjusted.

By the same principle as that on the low pressure side, the pressure chamber 11*b* on the high pressure side and the liquid flow chamber 10*b*-1 communicate to each other, and the pressure of the liquid ejection head 200 is adjusted.

In a manufacturing process of the liquid ejection head, inspection such as an ejection operation is performed by supplying a liquid such as an ink from the pressure control unit 100 to the liquid ejection unit 101 with use of the liquid supply system illustrated in FIG. 1. When the inspection is finished, a cleaning liquid is supplied to the pressure control unit 100 and the liquid ejection unit 101, and the liquid such as an ink is replaced by the cleaning liquid. Finally, air is supplied to the pressure control unit 100 and the liquid ejection unit 101 to discharge the cleaning liquid and dry the inside.

Figure 5:
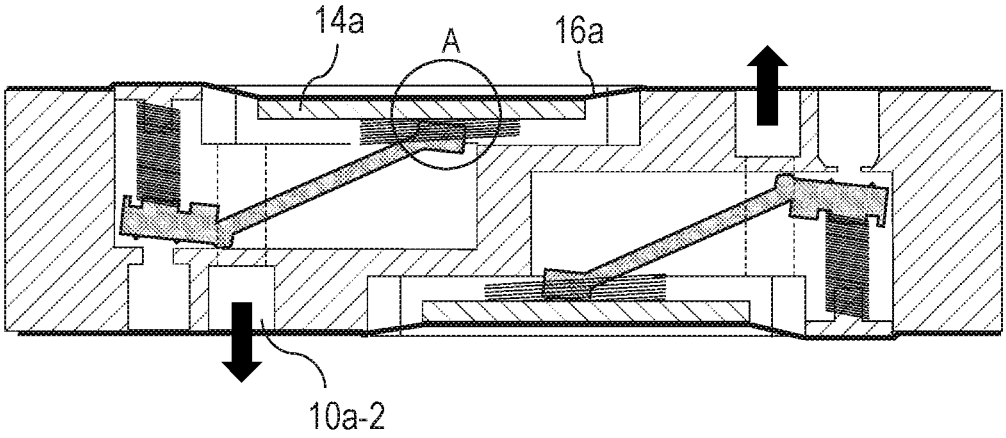
FIG. 5 is a schematic view for illustrating a state in which a cleaning liquid in the pressure control unit has been discharged.

FIG. 5 is a schematic view for illustrating a state in which the cleaning liquid in the pressure control unit 100 has been replaced by air. Air is supplied into the pressure control unit 100 through suction from the downstream side of the pressure control unit 100 with a pump. In FIG. 5, the black arrows each indicate a suction direction. Through the supply of air into the pressure control unit 100, the cleaning liquid in the pressure control unit 100 is replaced by air.

Figure 6:
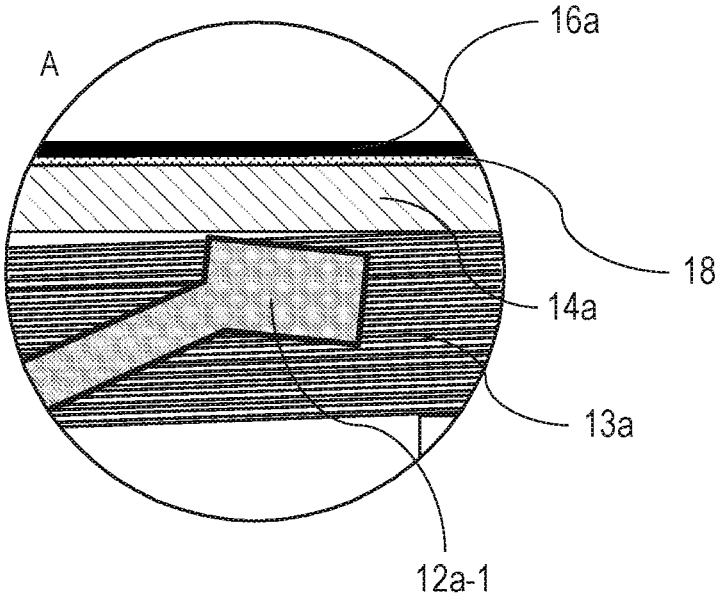
FIG. 6 is an enlarged view of a part of the pressure control unit illustrated in FIG. 5.

FIG. 6 is an enlarged view of a portion indicated by Ain FIG. 5. There is a gap 18 in a boundary portion between the pressure receiving plate 14*a* and the flexible member 16*a*, and the cleaning liquid remains in the gap 18. When the amount of the liquid that remains in the gap 18 can be reduced, an increase in humidity after packaging the liquid ejection head 200 can be suppressed, and the risk of substrate corrosion can be reduced.

First Embodiment

Figure 7:
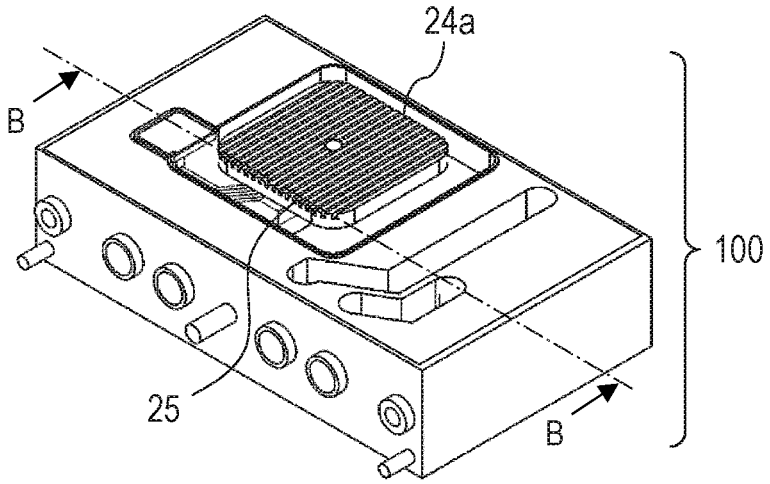
FIG. 7 is a schematic view for illustrating a pressure control unit according to a first embodiment of the present invention.

FIG. 7 is a schematic view for schematically illustrating the outer appearance of a pressure control unit according to a first embodiment of the present invention. A pressure control unit 100 of the first embodiment is the same as that illustrated in FIG. 2 to FIG. 6 except that the pressure receiving plate is different. The same configurations as those illustrated in FIG. 2 to FIG. 6 are denoted by the same reference symbols as those therein, and the detailed description thereof is omitted.

A pressure receiving plate 24*a* is provided on the inner surface of the flexible member 16*a* of the pressure chamber 11*a* on the low pressure side. An internal flow passage 25 is formed in a boundary portion between the pressure receiving plate 24*a* and the flexible member 16*a*. The internal flow passage 25 is formed so as to extend in the boundary portion along the inner surface of the flexible member 16*a* and be opened on a side surface of the pressure receiving plate 24*a*. The pressure receiving plate 24*a* is made of a synthetic resin such as polypropylene. The shape of an abutment surface of the pressure receiving plate 24*a* that is brought into abutment against the flexible member 16*a* is different from that of the pressure receiving plate 14*a* illustrated in FIG. 2 to FIG. 6. Although only the pressure receiving plate 24*a* on the low pressure side is illustrated in FIG. 7, a pressure receiving plate similar to the pressure receiving plate 24*a* is provided also on the high pressure side to form an internal flow passage.

Figure 8:
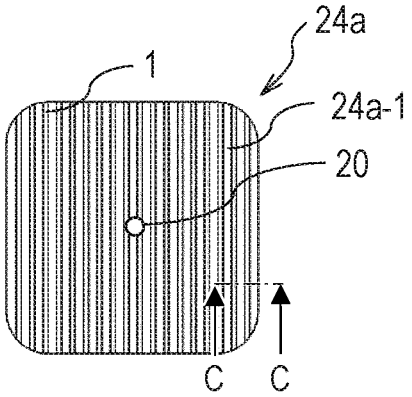
FIG. 8 is a top view of a pressure receiving plate of the pressure control unit illustrated in FIG. 7.

FIG. 8 is a top view of the pressure receiving plate 24*a*. The pressure receiving plate 24*a* has an abutment surface 24*a*-1 that is brought into abutment against the flexible member 16*a*. A plurality of recesses 1 are formed on the entire abutment surface 24*a*-1, and a welding portion 20 for fixing to the inner surface of the flexible member 16*a* is formed at the center of the abutment surface 24*a*-1. Here, the abutment surface means the entire surface including the recesses that is brought into abutment against the inner surface of the flexible member 16*a*. Each of the recesses 1 and the inner surface of the flexible member 16*a* form the internal flow passage 25. Here, the plurality of recesses 1 are a plurality of grooves extending in parallel to each other in the same direction. A pressure receiving plate 24*b* (see FIG. 10) also has the same structure as that of the pressure receiving plate 24*a*. The pressure receiving plates 24*a* and 24*b* are welded to the case 5 together with the flexible members 16*a* and 16*b*. For example, the pressure receiving plates 24*a* and 24*b* are welded to the flexible members 16*a* and 16*b*, respectively, and the flexible members 16*a* and 16*b* are then welded to the case 5.

The welding portion 20 of the pressure receiving plate 24*a* is welded to the flexible member 16*a*. Instead of this, a part (portion corresponding to the welding portion 20) of the pressure receiving plate 24*a* may be bonded to the flexible member 16*a* via an adhesive having resistance to a liquid such as an ink and a cleaning liquid.

Figure 9:
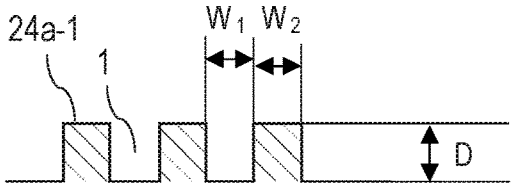
FIG. 9 is a sectional view of the pressure receiving plate taken along the line C-C of FIG. 8.

FIG. 9 is a partial sectional view of the pressure receiving plate 24*a* taken along the line C-C of FIG. 8. As illustrated in FIG. 9, the width of the recess 1 is represented by $W_1$, the groove depth of the recess 1 is represented by D, and the width of the abutment surface 24*a*-1 between two recesses 1 adjacent to each other is represented by $W_2$. When the flexible member 16*a* is brought into close contact with a bottom surface and side walls of each of the recesses 1, a liquid remains in a gap formed in the close contact portion. In order to prevent the liquid from remaining, it is preferred to set $W_1 \leq D$. According to this relationship, the flexible member 16*a* is less liable to be brought into close contact with the bottom surface or the side surface of each of the recesses 1. In the first embodiment, for example, the width $W_1$ is set to 0.8 mm, and the depth D is set to 1.0 mm.

In order to reduce the amount of the liquid that remains in the gap 18 (see FIG. 6) between the inner surface of the flexible member 16*a* and the abutment surface 24*a*-1 of the pressure receiving plate 24*a*, it is preferred that the width $W_2$ of the abutment surface 24*a*-1 be as narrow as possible. In the first embodiment, for example, the width $W_2$ is set to 0.5 mm. In addition, when the area of the abutment surface 24*a*-1 is smaller, the amount of the liquid that remains in the gap 18 can be reduced. In order to reduce the area of the abutment surface 24*a*-1, corner portions formed by the side walls of the recesses 1 and the abutment surface 24*a*-1 may be chamfered. Through chamfering, the area of the abutment surface 24*a*-1 can be reduced, and the amount of the liquid that remains in the gap 18 can be further reduced.

Figure 10:
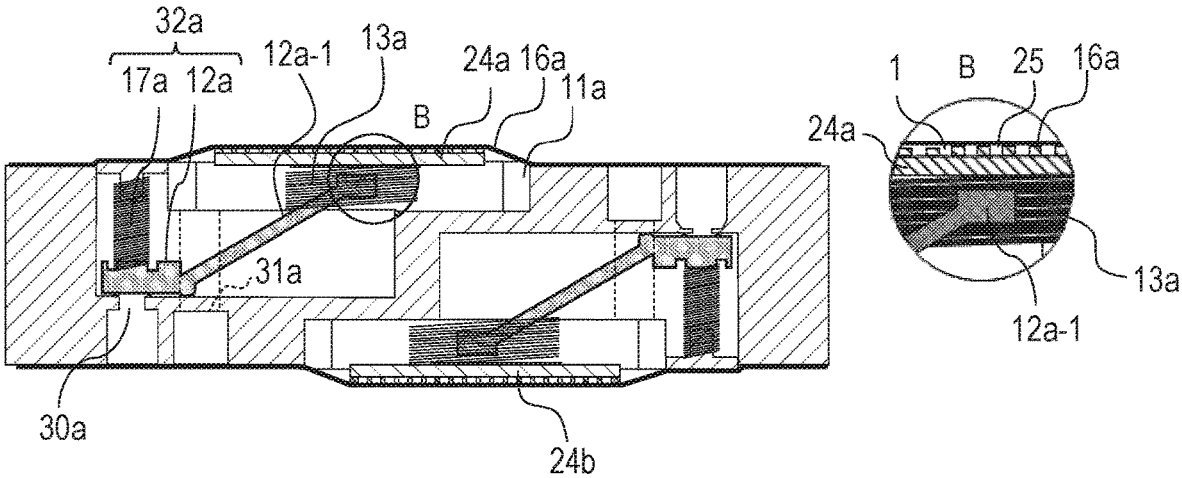
FIG. 10 is a sectional view of the pressure control unit taken along the line B-B of FIG. 7.

FIG. 10 is a sectional view for illustrating the configuration of a cross-section of the pressure control unit 100 taken along the line B-B of FIG. 7. In FIG. 10, a partial enlarged view of a portion indicated by B is also illustrated. As illustrated in FIG. 10, the pressure receiving plate 24*a* is provided on the inner surface of the flexible member 16*a* of the pressure chamber 11*a* on the low pressure side, and the pressure receiving plate 24*b* is provided on an inner surface of the flexible member 16*b* of the pressure chamber 11*b* on the high pressure side. The pressure receiving plate 24*a* and the pressure receiving plate 24*b* are the same. Each of the recesses 1 of the pressure receiving plate 24*a* and the inner surface of the flexible member 16*a* form the internal flow passage 25, and the flexible member 16*a* is not in close contact with the bottom surface and the side walls of each of the recesses 1 of the pressure receiving plate 24*a*. In the same manner as in the foregoing, each of the recesses 1 of the pressure receiving plate 24*b* and the inner surface of the flexible member 16*b* form the internal flow passage 25, and the flexible member 16*b* is not in close contact with the bottom surface and the side walls of each of the recesses 1 of the pressure receiving plate 24*b*.

Figure 11:
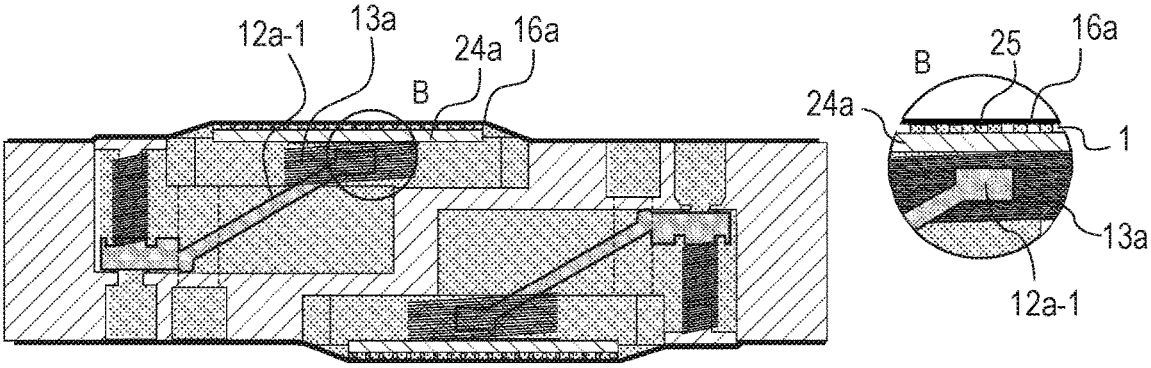
FIG. 11 is a schematic view for illustrating a state in which the pressure control unit is filled with a liquid.

FIG. 11 is a schematic view for illustrating a state in which the pressure control unit 100 is filled with the liquid. In FIG. 11, the cross-section of the pressure control unit 100 taken along the line B-B of FIG. 7 is illustrated, and a partial enlarged view of the portion indicated by B is further illustrated. Also in the example of FIG. 11, the liquid is filled into the pressure chambers 11*a* and 11*b* by the same principle as that in the filling example of FIG. 4. In this case, in each of boundary portions between the pressure receiving plates 24*a* and 24*b* and the flexible members 16*a* and 16*b*, the liquid enters the internal flow passage 25 as well as the gap 18.

Figure 12:
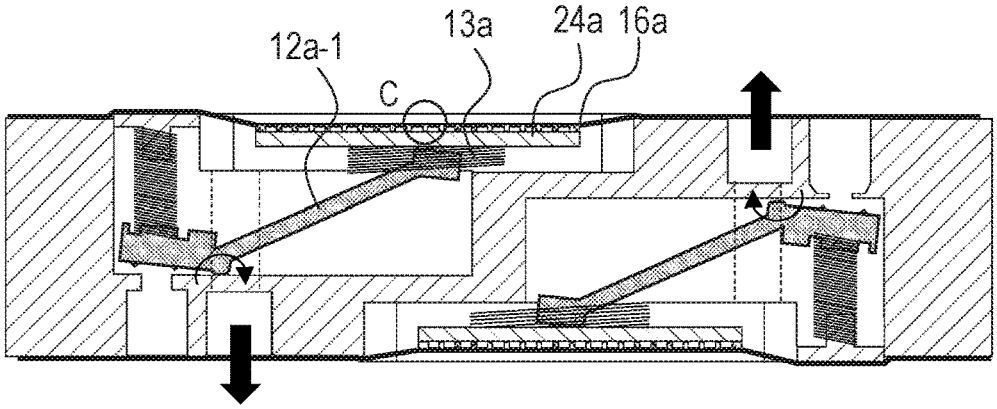
FIG. 12 is a schematic view for illustrating a state in which a cleaning liquid in the pressure control unit has been discharged.
Figure 13:
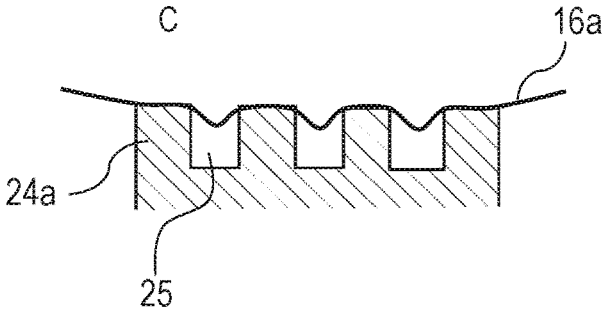
FIG. 13 is an enlarged view of a part of the pressure control unit illustrated in FIG. 12.

FIG. 12 is a schematic view for illustrating a state in which the cleaning liquid in the pressure control unit 100 has been replaced by air. In FIG. 12, the cross-section of the pressure control unit 100 taken along the line B-B of FIG. 7 is illustrated. FIG. 13 is a partial enlarged view of the portion indicated by C in FIG. 12. Also in the example of FIG. 12, the cleaning liquid in the pressure chambers 11*a* and 11*b* is replaced by air by the same principle as that of the replacement example of FIG. 5.

As illustrated in FIG. 13, the flexible member 16*a* is not in close contact with the bottom surface and the side walls of each of the recesses 1 of the pressure receiving plate 24*a*. In the same manner as the foregoing, the flexible member 16*b* is not in close contact with the bottom surface and the side walls of each of the recesses 1 of the pressure receiving plate 24*b*. Accordingly, air can flow through the internal flow passage 25 and discharge the cleaning liquid in the internal flow passage 25. Meanwhile, the abutment surfaces 24*a*-1 and 24*b*-1 of the pressure receiving plates 24*a* and 24*b* are in close contact with the flexible members 16*a* and 16*b*, and hence it is difficult for air to pass through the gap 18. As a result, the cleaning liquid remains in the gap 18.

In the pressure control unit 100 according to the first embodiment, a part of the liquid that remains in the boundary portions between the pressure receiving plates 24*a* and 24*b* and the flexible members 16*a* and 16*b* can be discharged by forming the internal flow passage 25. Accordingly, the residual amount of the liquid can be reduced, and the removability of the liquid can be improved. As described above, the removability of the liquid in the pressure control unit 100 is improved, and hence an increase in humidity after packaging the liquid ejection head 200 can be suppressed to reduce the risk of substrate corrosion.

In the pressure receiving plate 24*a* of FIG. 8, the plurality of recesses 1 form a plurality of grooves extending in parallel to each other in the same direction, but the present invention is not limited thereto. Modification examples of the pressure receiving plate 24*a* are described below.

Figure 14:
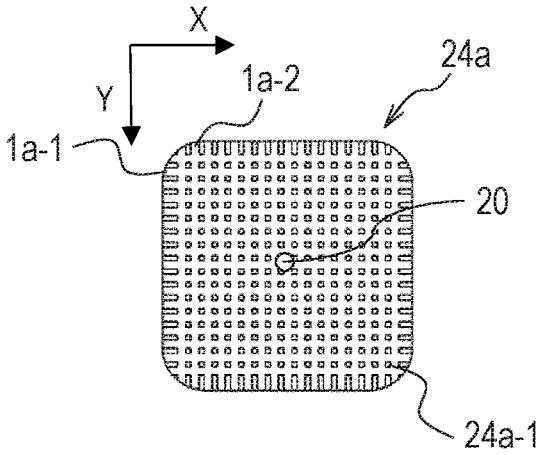
FIG. 14 is a schematic view for illustrating a pressure receiving plate of a first modification example.

FIG. 14 is a top view of the pressure receiving plate 24*a* of a first modification example. The pressure receiving plate 24*a* of the first modification example has a plurality of crossing grooves on the abutment surface 24*a*-1. Specifically, a plurality of first grooves 1*a*-1 parallel to each other extending in a first direction (for example, an X-axis direction) and a plurality of second grooves 1*a*-2 parallel to each other extending in a second direction (for example, a Y-axis direction) crossing the first direction are formed on the abutment surface 24*a*-1. The plurality of first grooves 1*a*-1 and the plurality of second grooves 1*a*-2 cross each other.

In the pressure receiving plate 24*a* of the first modification example, the internal flow passage is formed in a cross direction (first direction and second direction), and hence the inflow direction of air to the boundary portion between the pressure receiving plate 24*a* and the flexible member 16*a* is increased as compared to that illustrated in FIG. 8. Accordingly, the liquid that has entered the internal flow passage can be efficiently discharged, and the drying efficiency is improved.

Figure 15A:
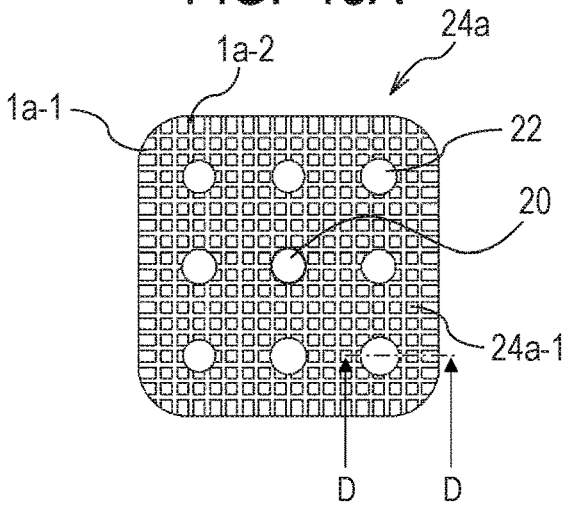
FIG. 15A is a top view for illustrating a pressure receiving plate of a second modification example.
Figure 15B:
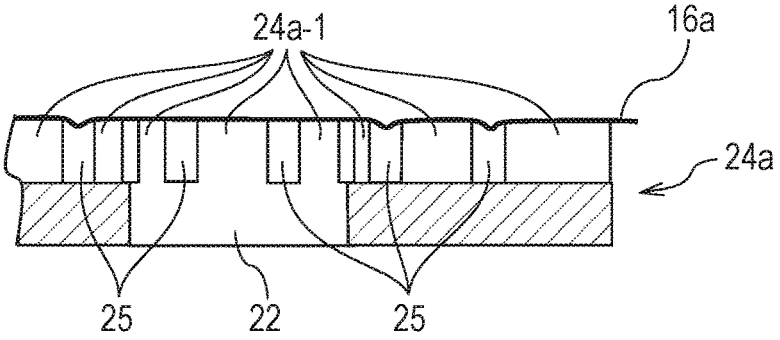
FIG. 15B is a sectional view for illustrating the pressure receiving plate taken along the line D-D of FIG. 15A.
Figure 15C:
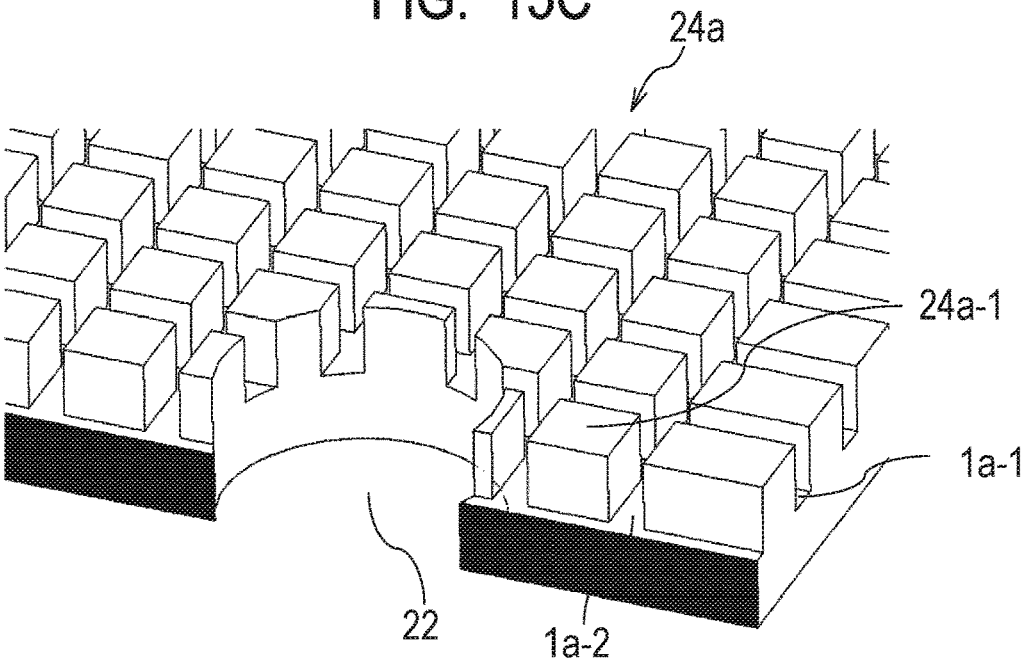
FIG. 15C is a perspective view of a sectional portion taken along the line D-D of FIG. 15A.

FIG. 15A is a top view of the pressure receiving plate 24*a* of a second modification example. FIG. 15B is a sectional view of the pressure receiving plate 24*a* taken along the line D-D of FIG. 15A. FIG. 15C is an enlarged perspective view for illustrating the periphery of the cross-section taken along the line D-D of FIG. 15A. In FIG. 15B, a state in which the pressure receiving plate 24*a* is in abutment against the flexible member 16*a* is illustrated. The pressure receiving plate 24*a* of the second modification example has a plurality of through holes 22 in addition to the crossing grooves 1*a*-1 and 1*a*-2 illustrated in FIG. 14. Each of the through holes 22 penetrates through the pressure receiving plate 24*a* in a thickness direction and communicates to the internal flow passage 25 formed by the grooves 1*a*-1 and 1*a*-2 and the inner surface of the flexible member 16*a*. Here, eight through holes 22 are formed so as to surround the welding portion 20, but the present invention is not limited thereto. The number and arrangement of the through holes 22 can be suitably changed.

In the pressure receiving plate 24*a* of the second modification example, the liquid that has entered the internal flow passage 25 can be discharged from the through holes 22, and hence the drying efficiency can be further improved as compared to that illustrated in FIG. 14.

Figure 16:
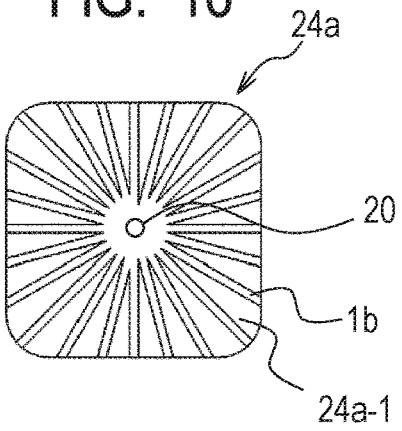
FIG. 16 is a schematic view for illustrating a pressure receiving plate of a third modification example.

FIG. 16 is a top view of the pressure receiving plate 24*a* of a third modification example. The pressure receiving plate 24*a* of the third modification example has a plurality of grooves 1*b* on the abutment surface 24*a*-1. The plurality of grooves 1*b* are formed in a radial pattern from the center portion of the pressure receiving plate 24*a*.

In the pressure receiving plate 24*a* of the third modification example, the internal flow passage 25 is formed in multiple directions, and hence the inflow direction of air into the boundary portion between the pressure receiving plate 24*a* and the flexible member 16*a* is increased as compared to that illustrated in FIG. 8. Accordingly, the liquid that has entered the internal flow passage 25 can be efficiently discharged, and the drying efficiency is improved.

In addition, it is not required to prepare a complicated molding die as compared to the ones each forming minute grooves as illustrated in FIG. 14 and FIGS. 15A to 15C, and hence the manufacturing cost can be reduced.

The configurations of the pressure receiving plates 24*a* illustrated in FIG. 8 and FIG. 14 to FIG. 16 can be suitably combined with each other. For example, the through holes 22 illustrated in FIGS. 15A to 15C can be applied to the pressure receiving plates 24*a* illustrated in FIG. 8 and FIG. 16.

Second Embodiment

Figure 17A:
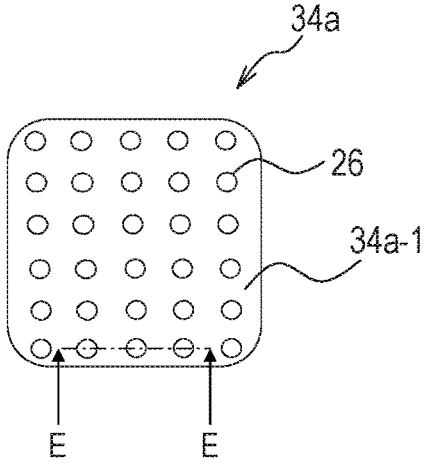
FIG. 17A is a plan view for illustrating a pressure receiving plate of a pressure control unit according to a second embodiment of the present invention.
Figure 17B:
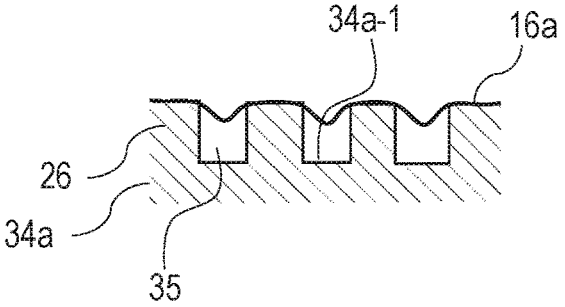
FIG. 17B is a schematic sectional view for illustrating the pressure receiving plate taken along the line E-E of FIG. 17A.

FIG. 17A is a top view of a pressure receiving plate to be used in a pressure control unit according to a second embodiment of the present invention. FIG. 17B is a sectional view of the pressure receiving plate taken along the line E-E of FIG. 17A. In FIG. 17B, a state in which a pressure receiving plate 34*a* is in contact with the inner surface of the flexible member 16*a* is illustrated. The pressure control unit according to the second embodiment has the same structure as that of the pressure control unit according to the first embodiment except that the pressure receiving plate 34*a* is different.

As illustrated in FIG. 17A and FIG. 17B, the pressure receiving plate 34*a* has a first surface 34*a*-1 opposed to the inner surface of the flexible member 16*a*. The recesses (grooves) described in the first embodiment are not formed on the first surface 34*a*-1, and instead of this, a plurality of protrusions 26 to be welded to the flexible member 16*a* are formed. The plurality of protrusions 26, the first surface 34*a*-1, and the inner surface of the flexible member 16*a* form an internal flow passage 35. The internal flow passage 35 is formed so as to extend in the boundary portion between the pressure receiving plate 34*a* and the flexible member 16*a* along the inner surface of the flexible member 16*a* and be opened on a side surface of the pressure receiving plate 34*a*.

The plurality of protrusions 26 are formed independently from each other. The plurality of protrusions 26 are arranged in a matrix pattern at predetermined intervals. Here, it is preferred that each of the predetermined intervals be equal to or less than the height of each of the protrusions 26. In this case, for the same reason as the relationship of the recess 1 ($W_1 \leq D$) described in the first embodiment, the flexible member 16*a* is less liable to be brought into close contact with the side surfaces of the protrusions 26 or the first surface 34*a*-1. The height of the protrusion 26 is the height from the first surface 34*a*-1 to the top of the protrusion 26. Each of the protrusions 26 has a columnar shape and has the same height. The shape of the protrusion 26 is not limited to the columnar shape. The shape of the protrusion 26 may be other shape such as a prismatic shape. In addition, the number and arrangement of the protrusions 26 can also be suitably changed.

In the pressure control unit according to the second embodiment, the first surface 34*a*-1 of the pressure receiving plate 34*a* is welded to the inner surface of the flexible member 16*a* through intermediation of the protrusions 26. Accordingly, the gap 18 described in the first embodiment is not formed in the boundary portion between the pressure receiving plate 34*a* and the flexible member 16*a*. In addition, when the pressure control unit is cleaned, a cleaning liquid enters the internal flow passage 35, but as in the first embodiment, the liquid that has entered the internal flow passage 35 can be discharged. Thus, as compared to the first embodiment, the amount of the liquid that remains in the boundary portion can be further reduced as the gap 18 is not formed, and the liquid removability can be further improved. Accordingly, an increase in humidity after packaging the liquid ejection head 200 can be further suppressed, and the risk of substrate corrosion can be reliably reduced.

Even when the entire first surface 34*a*-1 is welded to the inner surface of the flexible member 16*a* without forming the protrusions 26, the gap 18 is not formed. However, tension is always applied to the flexible member 16*a* by the negative pressure spring 13*a*, and the stress applied to the welding portion of the flexible member 16*a* with respect to the pressure receiving plate 34*a*, in particular, an edge portion of the pressure receiving plate 34*a* is large. As a result, the flexible member 16*a* may be damaged.

Meanwhile, in the second embodiment, the pressure receiving plate 34*a* is welded to the flexible member 16*a* through intermediation of the plurality of protrusions 26, and hence the stress applied to the flexible member 16*a* can be dispersed. Accordingly, the damage to the flexible member 16*a* can be suppressed.

In the pressure control unit according to the second embodiment, the pressure receiving plate 34*a* may have the through holes described in the first embodiment. In this case, the through holes communicate to the internal flow passage 35.

In addition, the plurality of protrusions 26 may be bonded to the inner surface of the flexible member 16*a* via an adhesive having resistance to a liquid such as an ink or a cleaning liquid.

Further, some of the plurality of protrusions 26 may be brought into abutment against the inner surface of the flexible member 16*a* without welding or bonding. For example, the protrusion 26 at the center is welded or bonded to the flexible member 16*a*, and a remainder of the protrusions 26 are brought into abutment against the inner surface of the flexible member 16*a*.

The plurality of protrusions 26 may be formed on the inner surface of the flexible member 16*a* instead of the pressure receiving plate 34*a*. Also in this case, the plurality of protrusions 26, the first surface 34*a*-1, and the inner surface of the flexible member 16*a* form the internal flow passage 35. The plurality of protrusions 26 are formed independently from each other and are arranged, for example, in a matrix pattern at predetermined intervals. It is preferred that each of the predetermined intervals be equal to or less than the height of each of the protrusions 26. The plurality of protrusions 26 may be welded or bonded to the first surface 34*a*-1 of the pressure receiving plate 34*a*. Some of the plurality of protrusions 26 may be brought into abutment against the first surface 34*a*-1 of the pressure receiving plate 34*a* without welding or bonding.

In the above-mentioned case, the flexible member 16*a* may be, for example, a film having a multilayer structure in which a first film having the plurality of protrusions 26 formed thereon and a weldable second film made of, for example, polypropylene are affixed to each other.

A method of drying the pressure control units according to the first and second embodiments described above is described. After inspection such as an ejection operation, the inside of the pressure chamber is cleaned with a cleaning liquid. After the cleaning, the inside of the internal flow passage as well as the inside of the pressure chamber are dried through suction from the flow outlet with use of a pump. In those steps, the liquid supply system illustrated in FIG. 1 can be used.

According to the present invention, it is possible to reduce the amount of the liquid that remains in the boundary portion between the pressure receiving plate and the flexible member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-056091, filed Mar. 29, 2021, and Japanese Patent Application No. 2021-196006, filed Dec. 2, 2021, which are hereby incorporated by reference herein in their entirety.

What is claimed is:

1. A pressure control unit comprising:

a pressure chamber configured to accommodate a liquid, at least a part of a wall forming the pressure chamber being formed of a flexible member;

a flow inlet configured to cause the liquid to flow into the pressure chamber;

a flow outlet configured to cause the liquid to flow out from the pressure chamber;

a pressure receiving plate, which is provided on an inner surface of the flexible member, and is to be displaced toward an inner side and an outer side of the pressure chamber;

a valve member configured to open and close the flow inlet in accordance with the displacement of the pressure receiving plate; and an internal flow passage, which extends in a boundary portion between the pressure receiving plate and the flexible member along the inner surface of the flexible member, and is opened on a side surface of the pressure receiving plate.

2. The pressure control unit according to claim 1, wherein the pressure receiving plate has an abutment surface to be brought into abutment against the inner surface of the flexible member, wherein the abutment surface has recesses, and wherein the recesses and the inner surface of the flexible member form the internal flow passage.

3. The pressure control unit according to claim 2, wherein the recesses are formed of a plurality of grooves.

4. The pressure control unit according to claim 3, wherein the plurality of grooves extend in parallel to each other in the same direction.

5. The pressure control unit according to claim 3, wherein the plurality of grooves include a plurality of first grooves parallel to each other extending in a first direction and a plurality of second grooves parallel to each other extending in a second direction crossing the first direction, and wherein the plurality of first grooves and the plurality of second grooves cross each other.

6. The pressure control unit according to claim 3, wherein the plurality of grooves are formed in a radial pattern from a center portion of the pressure receiving plate.

7. The pressure control unit according to claim 2, wherein each of the recesses has a width equal to or less than a depth of each of the recesses.

8. The pressure control unit according to claim 2, wherein corner portions formed by side walls of the recesses and the abutment surface are chamfered.

9. The pressure control unit according to claim 1, wherein the flexible member has a plurality of protrusions on the inner surface, and wherein the plurality of protrusions, the inner surface, and a first surface of the pressure receiving plate opposed to the inner surface form the internal flow passage.

10. The pressure control unit according to claim 9, wherein the plurality of protrusions are welded or bonded to the first surface of the pressure receiving plate.

11. The pressure control unit according to claim 9, wherein the plurality of protrusions are arranged in a matrix pattern at predetermined intervals.

12. The pressure control unit according to claim 11, wherein the predetermined intervals are each equal to or less than a height of each of the protrusions.

13. The pressure control unit according to claim 1, wherein the pressure receiving plate has a first surface opposed to the inner surface of the flexible member, wherein the first surface has a plurality of protrusions, and wherein the plurality of protrusions, the first surface, and the inner surface of the flexible member form the internal flow passage.

14. The pressure control unit according to claim 13, wherein the plurality of protrusions are welded or bonded to the inner surface of the flexible member.

15. The pressure control unit according to claim 1, wherein the pressure receiving plate has at least one through hole penetrating through the pressure receiving plate in a thickness direction thereof, and wherein the through hole communicates to the internal flow passage.

16. A liquid ejection head comprising:

the pressure control unit of claim 1; and a recording element substrate configured to eject a liquid, wherein the liquid is supplied to the recording element substrate through the pressure control unit.

17. A method of drying the pressure control unit of claim 1, comprising:

cleaning an inside of the pressure chamber with a cleaning liquid; and drying an inside of the internal flow passage as well as the inside of the pressure chamber through suction from the flow outlet with use of a pump.

* * * * *